US008038275B2

(12) United States Patent
Hattori

(10) Patent No.: US 8,038,275 B2
(45) Date of Patent: Oct. 18, 2011

(54) LIQUID CONTAINERS

(75) Inventor: Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 953 days.

(21) Appl. No.: 11/961,118

(22) Filed: Dec. 20, 2007

(65) Prior Publication Data

US 2008/0239033 A1 Oct. 2, 2008

(30) Foreign Application Priority Data

Mar. 28, 2007 (JP) ..... 2007-083778
Mar. 30, 2007 (JP) ..... 2007-095477

(51) Int. Cl.
*B41J 2/175* (2006.01)
*B41J 2/195* (2006.01)

(52) U.S. Cl. ..... 347/86; 347/7

(58) Field of Classification Search ..... 347/7, 85, 347/86, 87
See application file for complete search history.

(56) References Cited

U.S. PATENT DOCUMENTS

| | | | | |
|---|---|---|---|---|
| 6,899,418 | B2 * | 5/2005 | Sasaki et al. | 347/86 |
| 7,188,939 | B1 | 3/2007 | Sasaki | |
| 7,246,894 | B2 | 7/2007 | Hattori et al. | |
| 7,357,494 | B2 * | 4/2008 | Katayama et al. | 347/86 |
| 2003/0184626 | A1 | 10/2003 | Sasaki et al. | |
| 2005/0068389 | A1 | 3/2005 | Katayama et al. | |
| 2005/0162490 | A1 | 7/2005 | Katayama et al. | |
| 2006/0033789 | A1 | 2/2006 | Sasaki et al. | |
| 2006/0203049 | A1 | 9/2006 | Ito et al. | |
| 2007/0229615 | A1 | 10/2007 | Hattori et al. | |
| 2007/0291088 | A1 | 12/2007 | Katayama et al. | |

FOREIGN PATENT DOCUMENTS

| | | | |
|---|---|---|---|
| EP | 1772270 | A2 | 6/2006 |
| EP | 1839871 | A1 | 6/2006 |
| EP | 1792736 | A1 | 6/2007 |
| EP | 1839873 | A1 | 10/2007 |
| EP | 1886821 | A2 | 2/2008 |
| JP | 2005-125738 | A | 5/2005 |
| JP | 2006-248048 | A | 9/2006 |

OTHER PUBLICATIONS

Japan Patent Office; Notice of Reasons for Rejection in Japanese Patent Application No. 2007-095477 (counterpart to the above-captioned U.S. patent application) mailed Apr. 13, 2010

European Patent Office, European Search Report for Related EP Application No. 08003711 dated Jul. 17, 2008.

* cited by examiner

*Primary Examiner* — Anh T. N. Vo
(74) *Attorney, Agent, or Firm* — Baker Botts L.L.P.

(57) ABSTRACT

A liquid container includes a case, a translucent portion, an ink supply portion, and a movable member. The case defines a liquid chamber which is configured to store a predetermined amount of liquid. The translucent portion extends away from the liquid chamber in a predetermined direction, and has an inner space formed therein. The ink supply portion has a center line which is parallel to the predetermined direction. The movable member is pivotably positioned within the liquid chamber, and includes a signal blocking portion, a float portion, and an arm portion. At least a portion of the signal blocking portion is configured to be positioned within the inner space. Moreover, when the liquid chamber stores the predetermined amount of liquid, at least a portion of the arm portion is positioned further from the center line than the signal blocking portion is positioned from the center line.

16 Claims, 6 Drawing Sheets

LIQUID CONTAINERS

CROSS-REFERENCE TO RELATED APPLICATIONS

The present invention claims priority from Japanese Patent Application No. 2007-083778, which was filed on Mar. 28, 2007, and Japanese Patent Application No. JP-2007-095477, which was filed on Mar. 30, 2007, the disclosures of which are incorporated herein by reference in their entirety.

BACKGROUND OF THE INVENTION

1. Field of the Invention

The present invention relates generally to liquid containers comprising a movable member which indicates whether an amount of ink stored in the liquid container is a sufficient amount of ink.

2. Description of Related Art

A known ink-jet printer is configured to dispense ink onto a sheet of paper to record an image on the sheet of paper. The known ink-jet printer has a recording head. The recording head is configured to selectively eject ink from nozzles to the sheet of paper. A known ink cartridge is configured to be removably mounted to the ink-jet printer. The ink cartridge has an ink chamber configured to store ink therein, and ink is supplied from the ink chamber to the recording head when the ink cartridge is mounted to the ink-jet printer.

The ink cartridge has a movable member disposed in the ink chamber. The movable member is configured to pivot based on the amount of ink stored in the ink chamber. When the ink is consumed and the amount of ink in the ink chamber becomes less than a sufficient amount of ink, an end of the movable member moves from a first position at which the end of the movable member is detected by a detector e.g., an optical sensor, to a second position at which the end of the movable member is not detected by the detector. Consequently, whether the ink chamber has a sufficient amount of ink stored therein may be determined based on the position of the end of the movable member.

The movable member is submerged in ink when the ink chamber has an amount of ink which is substantially greater than a sufficient amount of ink. As the ink in the ink chamber gradually decreases, the movable member gradually becomes exposed above the surface of ink. When the movable member is exposed from the surface of ink, a web-shaped film of ink or a balloon-shaped film of ink may be formed between the movable member and the surface of ink. The film may inhibit or restrict the pivotal motion of the movable member, and the end of movable member may not be detected accurately. For example, when the movable member attempts to pivot away from the surface of ink, the film may pull the movable member towards the surface of ink. This problem may arise in known ink cartridges or in any known liquid container.

SUMMARY OF THE INVENTION

Therefore, a need has arisen for liquid containers, such as ink cartridges, which overcome these and other shortcomings of the related art. A technical advantage of the present invention is that an movable member readily may pivot in a direction away from a surface of liquid.

According to an embodiment of the present invention, a liquid container comprises a case, a translucent portion, an ink supply portion, and a movable member. The case is configured to define at least a portion of a liquid chamber therein, and the liquid chamber is configured to store a predetermined amount of liquid therein. The translucent portion extends away from the liquid chamber in a predetermined direction. Moreover, the translucent portion has an inner space formed therein, and the inner space is configured to be in liquid communication with the liquid chamber. The ink supply portion is configured to dispense liquid from an interior of the liquid chamber to an exterior of the liquid chamber, and the ink supply portion has a center line which is parallel to the predetermined direction. The movable member is pivotably positioned within the liquid chamber, and the movable member comprises a signal blocking portion, a float portion, and an arm portion. At least a portion of the signal blocking portion is configured to be positioned within the inner space of the translucent portion, and the signal blocking portion is connected to the float portion via the arm portion. Moreover, when the liquid chamber stores the predetermined amount of liquid, at least a portion of the arm portion is positioned further from the center line than the signal blocking portion is positioned from the center line.

According to an embodiment of the present invention, a liquid container comprises a case and a movable member. The case is configured to define at least a portion of a liquid chamber therein, and the liquid chamber is configured to store a predetermined amount of liquid therein. The movable member is positioned within the liquid chamber, and the movable member comprises a signal blocking portion, a float portion, and arm portion, and a pivot center. The arm portion comprises a first portion and a second portion, and the first portion comprises a first sub-portion and a second sub-portion. The movable member is configured to pivot about the pivot center, and the signal blocking portion is connected to the first sub-portion, the second sub-portion is connected to the first sub-portion and the pivot center, the second portion is connected to the pivot center, and the float portion is connected to the second portion. An angle formed between the first sub-portion and the second sub-portion is an acute angle.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Figure 1B:
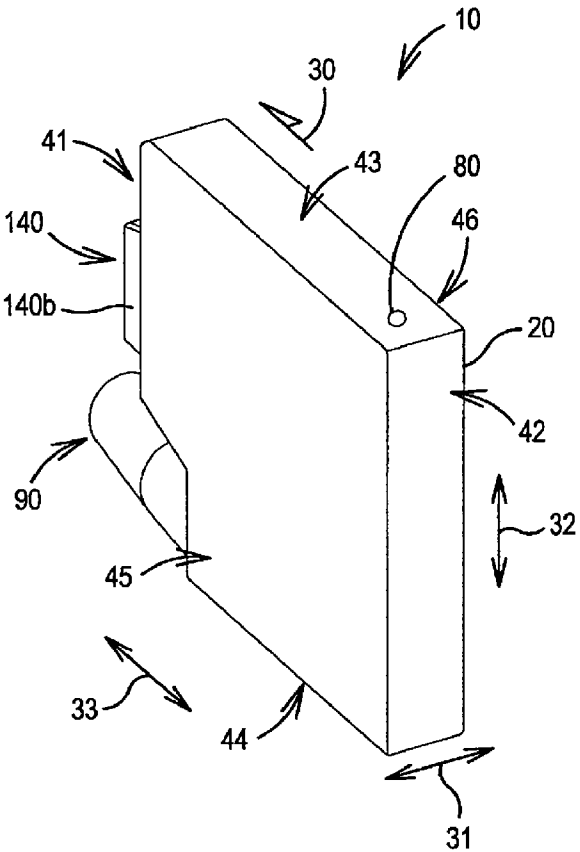
FIGS. 1(*a*) and 1(*b*) are a front-face perspective view and a rear-face perspective view of an ink cartridge, respectively, according to an embodiment of the present invention.
Figure 1A:
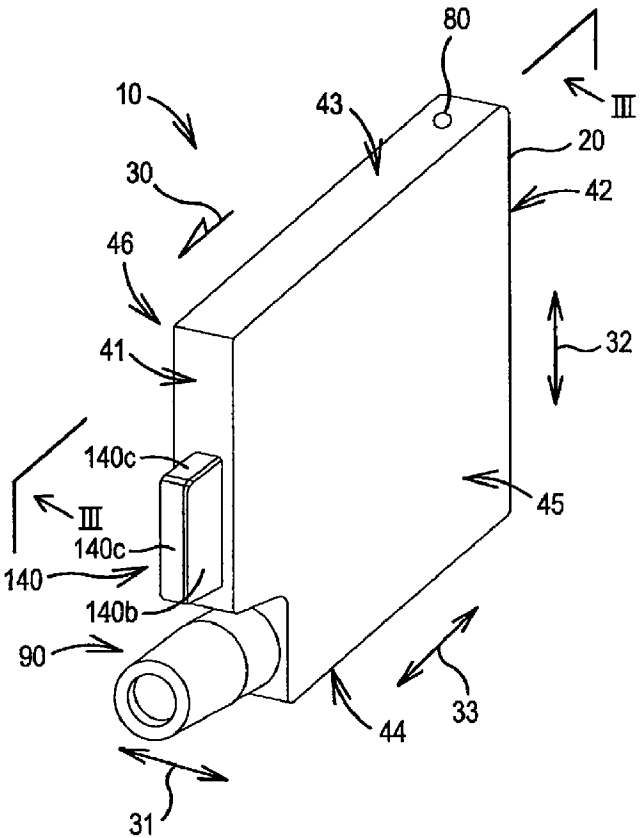
Figure 2:
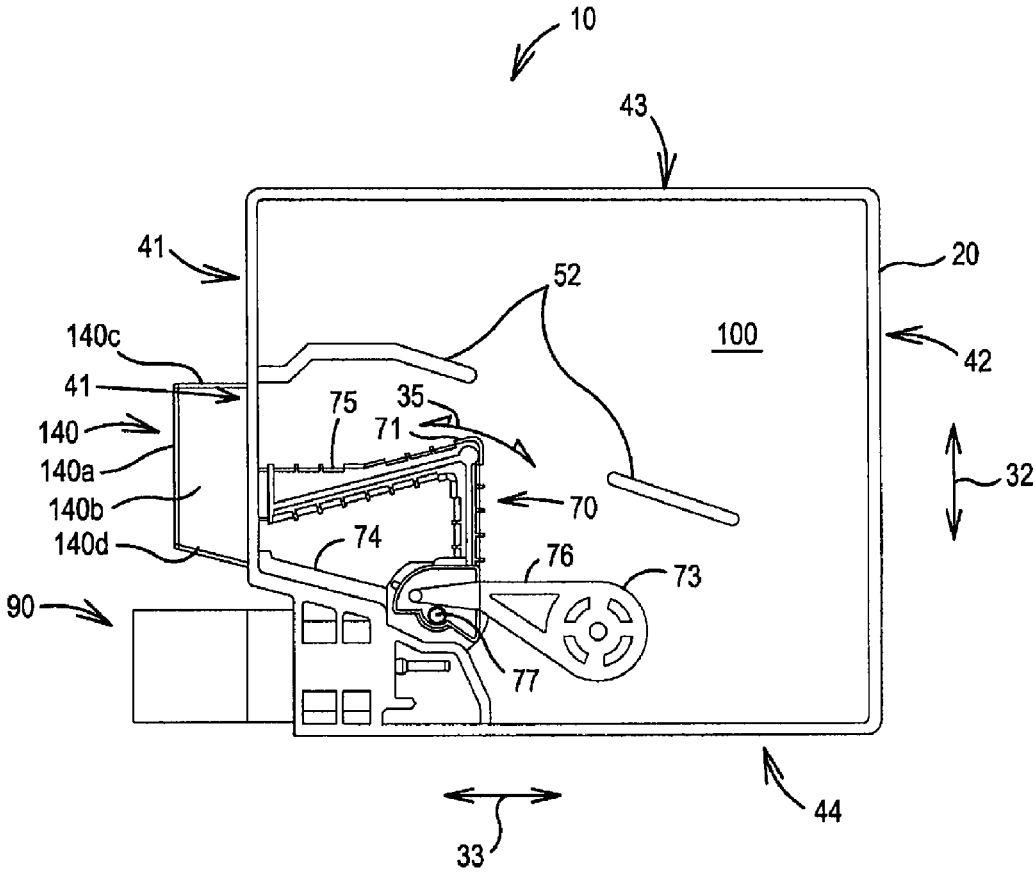
FIG. 2 is a side view of the ink cartridge of FIGS. 1(*a*) and 1(*b*), in which a right side wall of a main body of the ink cartridge is removed.

Embodiments of the present invention and their features and technical advantages may be understood by referring to FIGS. 1(*a*)-6, like numerals being used for like corresponding portions in the various drawings.

Referring to FIGS. 1(*a*) and 1(*b*), an ink cartridge 10, according to an embodiment of the present invention, is depicted. The ink cartridge 10 may be configured to be used in combination with an ink-jet printer. The ink cartridge 10 may be configured to be removably mounted to a mounting portion of the printer. When the ink cartridge 10 is mounted to the mounting portion, ink may be supplied from the ink cartridge 10 to a recording head (not shown) of the printer.

The ink cartridge 10 may have a substantially flat, hexahedron shape. A width of the ink cartridge 10, as indicated by an arrow 31, may be relatively short, and each of a height of the ink cartridge 10, as indicated by an arrow 32, and a depth of the ink cartridge 10, as indicated by an arrow 33, may be greater than the width of the ink cartridge 10. The ink cartridge 10 may be inserted into a printer in a direction indicated by an arrow 30.

Referring to FIGS. 1(*a*)-3, the ink cartridge 10 may comprise a case, e.g., a main body 20, a movable member 70, and an ink supply portion 90. The main body 20 may comprise an ink chamber 100 for storing ink. The main body 20 may comprise a translucent resin material, such as a transparent or semi-transparent resin material, e.g., a resin comprising polyacetal, nylon, polyethylene, polypropylene, or the like, or any combination thereof, to allow light to pass therethrough. The main body 20 may comprise a front wall 41, a rear wall 42, a top wall 43, and a bottom wall 44. The main body 20 also may comprise a pair of side walls 45 and 46 which oppose each other, and each of the side walls 45 and 46 are connected to the front wall 41, the rear wall 42, the top wall 43, and the bottom wall 44. Each of the side walls 45 and 46 may have a surface area which is greater than each of a surface area of the front wall 41, a surface area of the rear wall 42, a surface area of the top wall 43, and a surface area of the bottom wall 44. The main body 20 further may comprise inner walls 52 extending from one of the side walls 45 and 46 to the other of the side walls 45 and 46 to reinforce the rigidity of the main body 20.

The ink supply portion 90 may be positioned at the front wall 41 below the translucent portion 140. A valve (not numbered, but shown in FIG. 3) may be disposed within the ink supply portion 90. When the ink cartridge is not mounted to a mounting portion of a printer, the valve is closed, and fluid communication between the interior of the ink chamber 100 and the exterior of the ink cartridge 10 via the ink supply portion 90 is prevented. When the ink cartridge is mounted to the mounting portion of the printer, a pipe (not shown) positioned in the mounting portion enters the ink supply portion 90 and applies a force to the valve to open within the ink supply portion 90. When the valve is opened, the ink chamber 100 is brought into fluid communication with the exterior of the ink cartridge 10 via the ink supply portion 90, and ink is supplied from the interior of the ink chamber 100 to a recording head of the printer via the pipe. The ink supply portion 90 may have a center line C extending in a predetermined direction, and the ink supply portion 90 may extend away from the ink chamber 100 along the center line C.

A translucent portion 140 may be positioned at the front wall 41 of the main body 20 and may extend away from the ink chamber 100 in a direction parallel to the predetermined direction. An amount of ink stored in the ink chamber 100 may be optically or visually detected through the translucent portion 140. The translucent portion 140 may be integral with the main body 20, and may comprise the same material as the main body 20.

The translucent portion 140 may extend outward from a center portion of the front wall 41 of the main body 20 in the direction parallel to the predetermined direction away from the ink chamber 100. The translucent portion 140 may comprise five rectangular walls, and may have a substantially a hollow box shape. For example, the translucent portion 140 may comprise a front wall 140*a*, a pair of side walls 140*b*, a top wall 140*c*, and a bottom wall 140*d*. The front wall 140*a* extends parallel to the front wall 41 and is separated from the front wall 41 by a predetermined distance. The pair of side walls 140*b* are connected to the front wall 41 and the front wall 140*a*, the top wall 140*c* is connected to top ends of the front wall 140*a* and the side walls 140*b*, and the bottom wall 140*d* is connected to bottom ends of the front wall 140*a* and the side walls 140*b*. Moreover, the width of the front wall 140*a* may be less than the width of the front wall 41.

When the ink cartridge 10 is mounted to a printer, the translucent portion 140 may be configured to be sandwiched between a light-emitting element (not shown) and a light-receiving element (not shown) of an optical sensor (not shown), e.g. a photo interrupter, which is positioned in the printer. Light emitted by the light-emitting element may pass through the side walls 140*b*, and may be received by the light-receiving element.

The translucent portion 140 may have an inner space 142 formed therein, which is defined by the front wall 140*a*, the side walls 140*b*, the top wall 140*c* and the bottom wall 140*d*. The inner space 142 may be configured to be in fluid communication with the interior of the ink chamber 100, e.g., there may be no wall positioned between the inner space 142 and the ink chamber 100. The movable member 70 may be configured to move between a first position and a second position based on an amount of ink within the ink chamber 100. When the movable member 70 is in the first position, a signal blocking portion 72 of the movable member 70 may be positioned within the inner space 142, as indicated by a solid line in FIG. 3. When the movable member 70 is positioned in the second position, at least a portion of the signal blocking portion 72 may be positioned outside the inner space 142, as indicated by a dotted line in FIG. 3.

The movable member 70 is configured to indicate whether the ink chamber 100 has a sufficient amount of ink stored therein. The movable member 70 may comprise the signal blocking portion 72, a float portion 73, and an arm portion (not numbered). The signal blocking portion 72 is connected to the float portion 73 via the arm portion. The movable member 70 may be pivotably supported at a rib 74 extending from a portion of the main body 20 adjacent to a corner of the front wall 41 and the bottom wall 44. The arm portion comprises a pivot center, e.g., a middle portion (not numbered) having a shaft hole 78 formed therethrough, and the rib 74 may comprise a supporting shaft 77 extending through the shaft hole 78, such that the movable member 70 pivots about the middle portion of the arm portion, e.g., about the supporting shaft 77 and the shaft hole 78.

Figure 4:
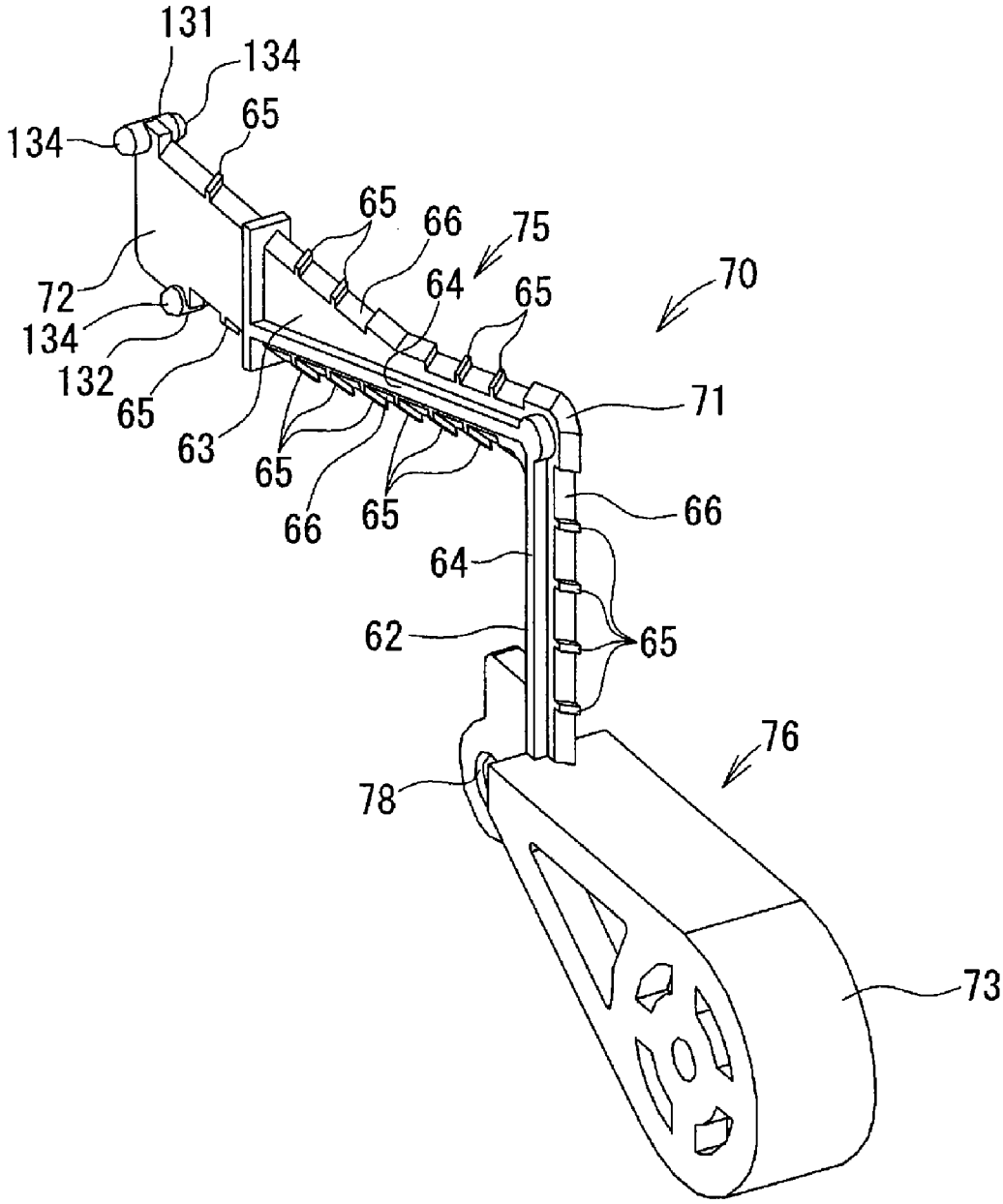
FIG. 4 is a perspective view of a movable member, according to an embodiment of the present invention.
Figures 5A, 5B, 5C:
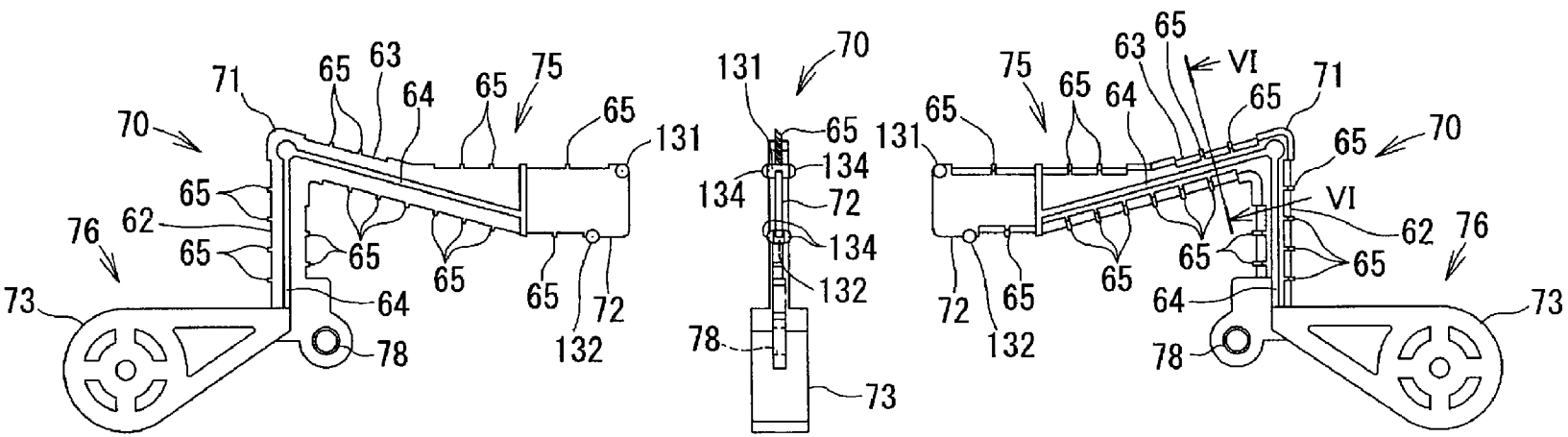
FIGS. 5(*a*)-5(*c*) is a left side view, a front view, and a right side view of the movable member of FIG. 4, respectively.
Figure 6:
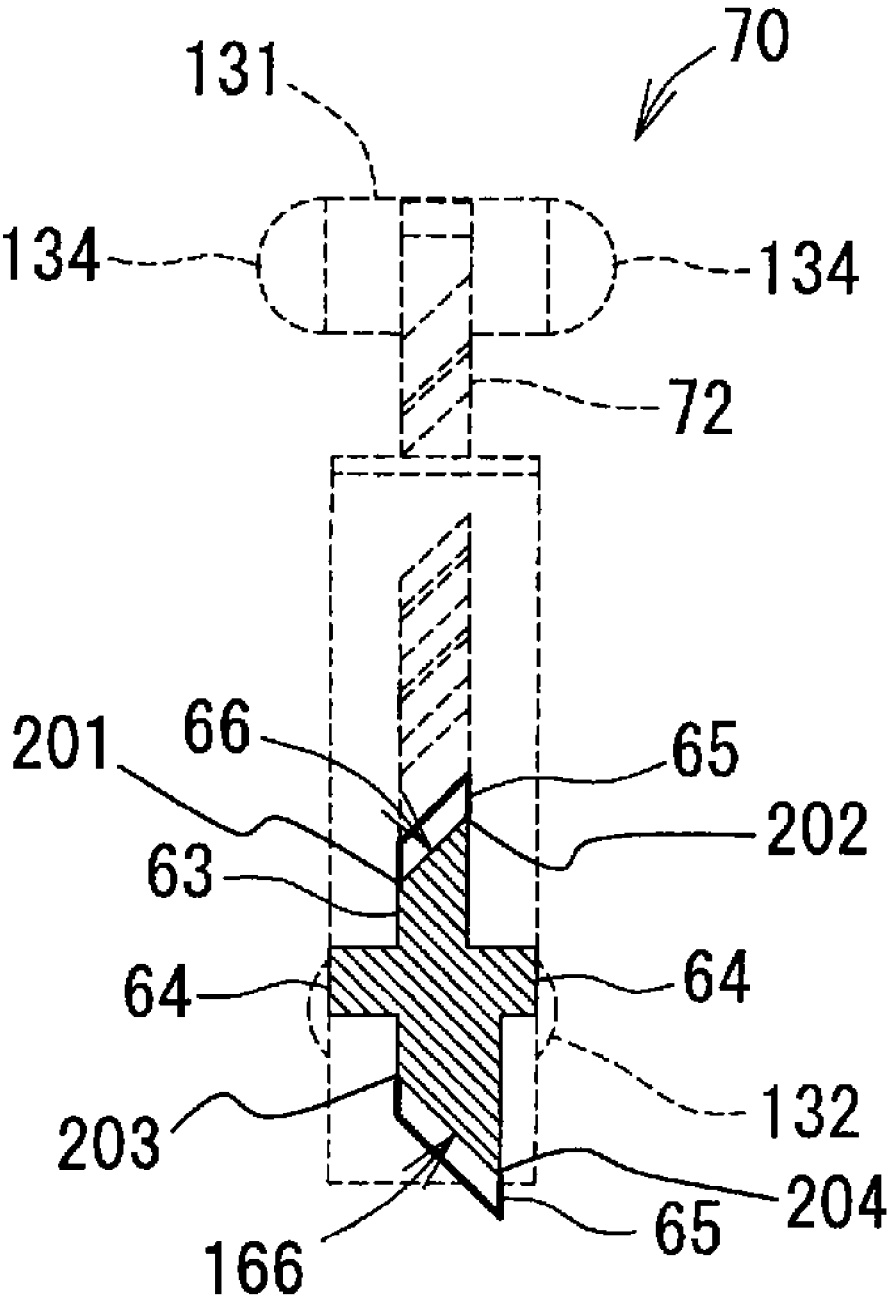
FIG. 6 is a cross-sectional view of the movable member taken along a line VI-VI in FIG. 5(*c*).

Referring to FIGS. 2-6, the movable member 70 and the movement of the movable member 70 are described. In FIG. 6, the cross-sectional surface is illustrated by a solid line, a projection 65 is illustrated by a bold line, and other portions of the movable member 70 are illustrated by dotted lines.

The arm portion of the movable member 70 may comprise a first portion 75 connected to the middle portion of the arm portion at one end, and connected to the signal blocking portion 72 at the other end. The arm portion of the movable member 70 also may comprise a second portion 76 connected to the middle portion of the arm portion at one end, and connected to the float portion 73 at the other end. The first portion 75 may extend from the middle portion of the arm portion to the left in FIG. 3, and the second portion 76 may extend from the middle portion of the arm portion to the right in FIG. 3. The shaft hole 78 may extend in a direction perpendicular to the paper plane of FIG. 3, and the supporting shaft 77 may extend in the direction perpendicular to the paper plane of FIG. 3. Each of the shaft hole 78 and the supporting shaft 77 may have a center line extending in the direction perpendicular to the paper plane of FIG. 3. The movable member 70 may be configured to pivot in a particular plane parallel to the paper plane of FIG. 3.

The specific gravity of the float portion 73 is less than the specific gravity of ink stored in the ink chamber 100. The float portion 73 may have a hollow formed therein, and the float portion 73 may float on liquid, such that the float portion 73 moves upward and downward based on the amount of ink within the ink chamber 100. The movable member 70 pivots based on the movement of the float portion 73. In another embodiment, the float portion 73 does not have the hollow, and comprises a material having a specific gravity less than the specific gravity of ink.

The signal blocking portion 72 is configured to indicate whether the ink chamber 100 has a sufficient amount of ink stored therein. When the movable member 70 pivots counterclockwise in FIG. 3, the signal blocking portion 72 moves into the inner space 142 and contacts the bottom wall 140*d*, such that further movement of the movable member 70 is prevented and the movable member remains in the first position. Similarly, when the movable member 70 pivots clockwise in FIG. 3, the signal blocking portion 72 moves away from the bottom wall 140*d*, and at least a portion of the signal blocking portion 72 moves out of the inner space 142. When the float portion 73 contacts a bottom surface of the ink chamber 100, further movement of the movable member 70 is prevented and movable member 70 remains in the second position, in which the signal blocking portion 72 is separated from the bottom wall 140*d* by a predetermined distance.

The signal blocking portion 72 may comprise a plurality of pin members 131 and 132. The pin member 131 may be positioned at an upper front end of the signal blocking portion 72. The pin member 132 may be positioned at the lower end of the signal blocking portion 72. Each of the pin members 131 and 132 may have a column shape and may be integral with the movable member 70. Each of the pin members 131 and 132 may extend in a width direction of the signal blocking portion 72, i.e., may extend left to right in FIG. 5(*b*). Each of the pin members 131 and 132 may project from both sides of signal blocking portion 72 towards side walls 140*b*. If the signal blocking portion 72 moves in the width direction, the pin members 131 and 132 contact the side wall 140*b*, and signal blocking portion 72 does not contact the side wall 140*b*. Consequently, the distance between the signal blocking portion 72 and the side walls 140*b* is maintained within a predetermined distance range. Therefore, the movement of the signal blocking portion 72 may be smoothened without being affected by the surface tension of the ink between the side walls 140*b* and the signal blocking portion 72, and the width of the translucent portion 140 may be made relatively narrow.

Ends 134 of the pin members 131 and 132 may be spherical. Therefore, even if the ends 134 of the pin member 131 and 132 contact the side wall 140*b*, it may be a single point of contact. Therefore, the movement of the signal blocking portion 72 may not be significantly affected by such contact between the pin member 131 and 132 and the side wall 140*b*. Moreover, even if ink is left between the ends 134 of the pin members 131 and 132 and the side wall 140*b* after the ink is removed from the translucent portion 140 as the ink level in the ink chamber 100 is lowered, the amount of ink left therebetween may be an insignificant amount of ink. Therefore, the movement of the signal blocking portion 72 in the translucent portion 140 may be smoothened without being affected by the left ink.

The mass of the first portion 75 is less than the mass of the second portion 76. Therefore, the second portion 76 is heavier than the first portion 75 in air. Accordingly, when the ink chamber 100 does not have a sufficient amount of ink, e.g., when the ink chamber 100 is empty of ink, the movable member 70 pivots clockwise about the supporting shaft 77 and the shaft hole 78 in FIG. 3, and at least a portion of the signal blocking portion 72 moves out of the inner space 142. When the lower end of the float portion 73 contacts the bottom surface of the ink chamber 100, the movable member 70 stops pivoting and the movable member 70 remains in the second position. When the movable member 70 is in the second position, in which the signal blocking portion 72 does not contact the bottom wall 140*d*, it may be determined that the ink chamber does not have a sufficient amount of ink.

When the ink chamber 100 has a sufficient amount of ink therein, and the float portion 73 is submerged in the ink, a buoyancy force acts on the float portion 73. This buoyancy force is great enough to cause the movable member 70 pivot counterclockwise about the supporting shaft 77 and the shat hole 78 in FIG. 3. When the movable member 70 pivots counterclockwise, the signal blocking portion 72 moves into the inner space 142. When the lower end of the signal blocking portion 72 contacts the bottom wall 140*d*, the movable member 70 stops pivoting and the movable member 70 remains in the first position. When the movable member 70 is in the first position, in which the signal blocking portion 72 contacts the bottom wall 140*d*, it may be determined that the ink chamber has a sufficient amount of ink.

Whether or not the ink chamber 100 has a sufficient amount of ink stored therein may be determined by a user viewing the position of the signal blocking portion 72 in the inner space 142, or by using an optical sensor e.g., a photo interrupter, to monitor the position of the signal blocking portion 72.

Figure 3:
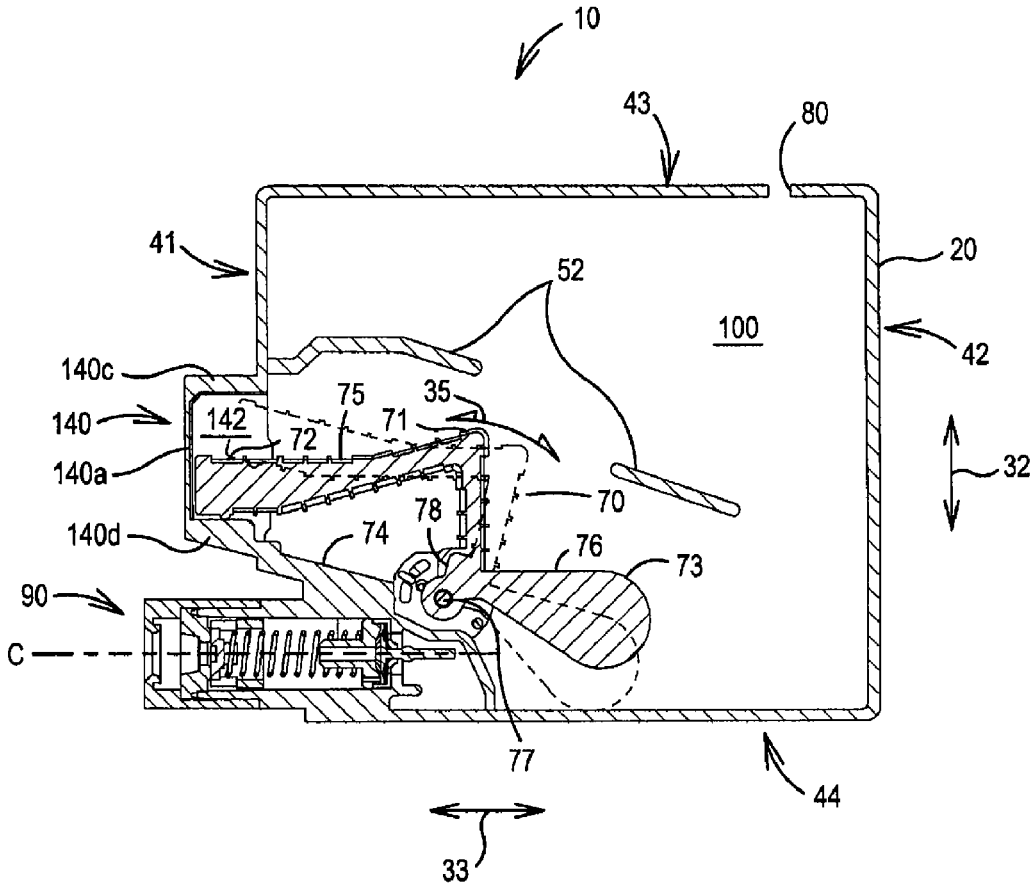
FIG. 3 is a cross-sectional view of the ink cartridge taken along a line III-III of FIG. 1(*a*).

Referring to FIG. 3, when the ink chamber 100 has a sufficient amount of ink therein, and the movable member 70 is in the first position, at least a portion of the first portion 75 may be positioned further from the center line C of the ink supply portion 90 than the signal blocking portion 72 is positioned from the center line C of the ink supply portion 90. In particular, a bent portion 71 of the first portion 75 and a portion of the first portion 75 adjacent to the bent portion 71 may be positioned further from the center line C of the ink supply portion 90 than the signal blocking portion 72 is positioned from the center line C of the ink supply portion 90.

Referring to FIGS. 4-6, the first portion 75 may comprise a first sub-portion 63 and a second sub-portion 62. Each of the first and second sub-portions 63 and 62 has a first end and a second end. The first end of the first sub-portion 63 may be connected to the signal blocking portion 72, the second end of the first sub-portion 63 may be connected to a first end of the second sub-portion 62, and the second end of the second sub-portion 63 may be connected to the middle portion of the arm portion. The first sub portion 62 and the second sub portion 63 may form an acute angle corner therebetween, and the corner of the first sub portion 62 and the second sub portion 63 may comprise the bent portion 71.

The first portion 75 may be a thin plate. The first portion 75 may have a first end 201, a second end 202, a third end 203, and a fourth end 204. The first portion 75 may comprise a first plane surface 66 having the first end 201 and the second end 202, a second plane surface 166 having the third end 203 and the fourth end 204, a right-side plane surface having the first end 201 and the third end 203, and a left-side plane surface having the second end 202 and the fourth end 204. The first plane surface 66 and the left-side plane surface may form an acute angle at the second end 202, and the second plane surface 166 and the lest-side plane surface may form an acute angle at the fourth end 204. The first portion 75 may have a first width corresponding to a distance between the first end 201 and the second end 202, and a second width corresponding to a distance between the third end 203 and the fourth end 204. The first portion 75 may have a length in a direction perpendicular to the first width and the second width of the first portion 75, and the length of the first portion 75 is greater than the first width and the second width of the first portion 75.

The first portion 75 may comprise ribs 64 formed on the left-side plane surface and the right-side plane surface of the first portion 75, respectively. The ribs 64 may extend from the bent portion 71 towards the signal blocking portion 72. The ribs 64 reinforce the rigidity of the first portion 75.

The first portion 75 also may comprise a plurality of the projections 65 extending from an outer peripheral surface of the first portion 75 and positioned at a predetermined interval from a portion adjacent to the shaft hole 78 to a portion adjacent to the signal blocking portion 72. More specifically, the projections 65 may extend from the first plane surface 66 and the second plane surface 166 of the first portion 75 in a direction parallel to a direction in which the first portion 75 pivots. The projections 65 may break or pop a film of ink formed between the first portion 75 and the surface of ink, or may prevent the film of ink from being formed between the first portion 75 and the surface of ink. The first plane surface 66 and the second plane surface 166 of the first portion 75 may be slanted and not perpendicular with respect to the direction in which the first portion 75 pivots. Each of the plurality of projections 65 may have a base connected to the first plane surface 66 or to the second plane surface 166, and a peak. Moreover, a thickness of the base may be greater than a thickness of the peak.

Referring to FIGS. 1(*a*), 1(*b*) and 3, an air intake hole 80 may formed through the top wall 43. Before the ink cartridge 10 is used, a sticker (not shown) may be placed on the top wall 43 to cover the air intake hole 80, and fluid communication between the interior of the ink chamber 100 and the exterior of the ink cartridge 10 via the air intake hole 80 may be prevented. When a user intends to use the ink cartridge 10, the user removes the sticker from the top wall 43, and thereby the ink chamber 100 may be brought into fluid communication with the exterior of the ink cartridge 10 via the air intake hole 80.

When the ink cartridge is mounted to a printer, the bent portion 71 of the first portion 75 and a portion of the first portion 75 adjacent to the bent portion 71 may be positioned above the signal blocking portion 72. Therefore, even when ink in the ink chamber 100 is gradually consumed and the movable member 70 becomes exposed to air, the possibility of the formation of the film of ink between the movable member 70 and the surface of ink or between the inner walls 52 and the movable member 70 may be less than in the known ink cartridges. Moreover, even if such a film of ink is formed, the bent portion 71 may break or pop the film of ink. Consequently, the pivotal movement of the movable member 70 away from the surface of ink may be smoothened.

Moreover, since the plurality of projections 65 may be formed on the first portion 75 of the movable member 70, even if the film of ink is formed between the movable member 70 and the surface of ink or between the inner walls 52 and the movable member 70, the film of ink may be broken or popped by the projections 65.

In another embodiment, the projections 65 may not be formed. Even in this case, the film of ink may be broken because the acute angles may be formed between the first plane surface 66 and the left-side plane and between the second plane surface 166 and the lest-side plane surface.

In another embodiment, the present invention may be applied also to liquid containers configured to store liquid other than ink, e.g., a viscous liquid.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. A liquid container comprising:

a case configured to define at least a portion of a liquid chamber therein, and the liquid chamber is configured to store a predetermined amount of liquid therein;

a translucent portion extending away from the liquid chamber in a predetermined direction, wherein the translucent portion has an inner space formed therein, and the inner space is configured to be in liquid communication with the liquid chamber;

a liquid supply portion configured to dispense liquid from an interior of the liquid chamber to an exterior of the liquid chamber, wherein the liquid supply portion has a center line which is parallel to the predetermined direction;

a movable member pivotably positioned within the liquid chamber, wherein the movable member comprises:

a signal blocking portion, wherein at least a portion of the signal blocking portion is configured to be positioned within the inner space of the translucent portion;

a float portion; and an arm portion, wherein the signal blocking portion is connected to the float portion via the arm portion, and when the liquid chamber stores the predetermined amount of liquid, at least a portion of the arm portion is positioned further from the center line than the entire signal blocking portion is positioned from the center line.

2. The liquid container of claim 1, wherein the movable member further comprises a pivot center, and the movable member is configured to pivot about the pivot center, and wherein the arm portion comprises a first portion and a second portion, the first portion is connected to the signal blocking portion and the pivot center, and the second portion is connected to the float portion and the pivot center, wherein at least a portion of the first portion is positioned further from the center line than the signal blocking portion is positioned from the center line.

3. The liquid container of claim 2, wherein the first portion comprises a first sub-portion connected to the signal blocking portion, and the first portion further comprises a second sub-portion connected to the first sub-portion and the pivot center, wherein an angle formed between the first sub-portion and the second sub-portion is an acute angle.

4. The liquid container of claim 1, wherein the movable member is configured to pivot within the liquid chamber between a first position and a second position based on an amount of liquid in the liquid chamber, wherein when the movable member is in the first position, the signal blocking portion is positioned within the inner space, and when the movable member is in the second position, at least a portion of the signal blocking member is positioned outside the inner space.

5. The liquid container of claim 1, wherein the movable member comprises a plurality of projections extending from an outer peripheral surface of the movable member.

6. The liquid container of claim 5, wherein each of the plurality of projections has a base connected to the outer peripheral surface of the movable member, and a peak, and a thickness of the base is greater than a thickness of the peak.

7. The liquid container of claim 5, wherein at least a portion of the plurality of projections extend in a direction parallel to a direction in which the movable member pivots.

8. The liquid container of claim 1, wherein the movable member has a width and a length which is greater than the width of the movable member, and a distance between a first end of the movable member and a second end of the movable member corresponds to the width of the movable member, and wherein the movable member comprises a plane surface having the first end of the movable member and the second end of the movable member, and the plane surface is slanted and not perpendicular with respect to a direction in which the movable member pivots.

9. The liquid container of claim 8, wherein the movable member comprises a plurality of projections extending from the plane surface.

10. A liquid container comprising:

a case configured to define at least a portion of a liquid chamber therein, and the liquid chamber is configured to store a predetermined amount of liquid therein; and a movable member positioned within the liquid chamber, wherein the movable member comprises:

a signal blocking portion;

a float portion;

an arm portion comprising a first portion and a second portion, wherein the first portion comprises a first sub-portion and a second sub-portion; and a pivot center, wherein the movable member is configured to pivot about the pivot center, and wherein the signal blocking portion is connected to the first sub-portion, the second sub-portion is connected to the first sub-portion and the pivot center, the second portion is connected to the pivot center, and the float portion is connected to the second portion, wherein an angle formed between the first sub-portion and the second sub-portion is an acute angle.

11. The liquid container of claim 10, further comprising a translucent portion extending away from the liquid chamber in a predetermined direction, wherein the translucent portion has an inner space formed therein, and the inner space is configured to be in liquid communication with the liquid chamber, and wherein the movable member is configured to pivot within the liquid chamber between a first position and a second position based on an amount of liquid in the liquid chamber, wherein when the movable member is in the first position, the signal blocking portion is positioned within the inner space, and when the movable member is in the second position, at least a portion of the signal blocking member is positioned outside the inner space.

12. The liquid container of claim 10, wherein the movable member comprises a plurality of projections extending from an outer peripheral surface of the movable member.

13. The liquid container of claim 12, wherein each of the plurality of projections has a base connected to the outer peripheral surface of the movable member, and a peak, and a thickness of the base is greater than a thickness of the peak.

14. The liquid container of claim 13, wherein each of the plurality of projections extends from the base to the peak in a direction parallel to a direction in which the movable member pivots.

15. The liquid container of claim 10, wherein the movable member has a width and a length which is greater than the width of the movable member, and a distance between a first end of the movable member and a second end of the movable member corresponds to the width of the movable member, and wherein the movable member comprises a plane surface including the first end of the movable member and the second end of the movable member, and the plane surface is slanted and not perpendicular with respect to a direction in which the movable member pivots.

16. The liquid container of claim 15, wherein the movable member comprises a plurality of projections extending from the plane surface.

* * * * *